US006606955B2

(12) United States Patent
Warren

(10) Patent No.: US 6,606,955 B2
(45) Date of Patent: Aug. 19, 2003

(54) RE-CONFIGURABLE PALLET FOR USE IN AUTOMATED MANUFACTURING OR MATERIAL HANDLING

(75) Inventor: Timothy C. Warren, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 66 days.

(21) Appl. No.: 09/725,227

(22) Filed: Nov. 29, 2000

(65) Prior Publication Data

US 2002/0062765 A1 May 30, 2002

(51) Int. Cl.[7] ..... B65D 19/44
(52) U.S. Cl. ..... 108/55.3; 269/266; 33/561.1
(58) Field of Search ..... 108/54.1, 55.3; 33/561.1, 561.2, 561.3; 269/266, 267; 12/142 N; 264/223; 249/82, 155

(56) References Cited

U.S. PATENT DOCUMENTS 2,266,457 A * 12/1941 Wolff ..... 33/561.1
2,621,415 A * 12/1952 Cooper ..... 33/561.1
4,936,560 A * 6/1990 Barozzi ..... 33/561.1
5,984,293 A * 11/1999 Abrahamson et al. ..... 269/266
6,029,966 A * 2/2000 Hertz et al. ..... 269/266

* cited by examiner

*Primary Examiner*—Lanna Mai
*Assistant Examiner*—Jerry Anderson
(74) *Attorney, Agent, or Firm*—Oliff & Berridge PLC

(57) ABSTRACT

A method and an apparatus for providing a re-configurable or adaptive manufacturing pallet that conforms to the shape of an object. The pallet comprises a frame that includes a matrix of displaceable object contacts points, such as a matrix of vertically displaceable fine rods or pins, that is laid over the object to form a cradle that conforms to the shape of the object; and a locking mechanism to lock the object contact points in a fixed position relative to each other in order to form a nest or cradle for holding the object in position during a manufacturing or assembly operation. In a preferred structure, the frame includes at least two substantially parallel guide plates having a matrix of guide holes, at least one actuator plate between and substantially parallel to said guide plates which also having a matrix of holes substantially aligned with the guides holes of the guide plates, a matrix of pins extending through and displaceable within the matrix of holes of the guide and actuator plates, and an actuator that applies a shear force against the pins to lock them in a fixed vertical position relative to said plates whereby to form cradle for holding an object in place.

5 Claims, 3 Drawing Sheets

RE-CONFIGURABLE PALLET FOR USE IN AUTOMATED MANUFACTURING OR MATERIAL HANDLING

BACKGROUND OF THE INVENTION

The present invention relates to automated manufacturing or material handling, but more specifically to a method and an apparatus for providing a re-configurable pallet for holding parts, objects, or work pieces in an automated material handling operation.

In the field of automated manufacturing, for example, in which articles of various shapes and sizes are manipulated, assembled, machined, or otherwise handled, there is a need for quick changeover of assembly systems to facilitate manufacturing. Changeovers of work piece pallets requiring only a few moments or seconds are desired but are often encumbered by the methods by which parts are carried through an automated assembly sequence or by various sizes and shapes of the parts. Currently, the transport of parts and subassemblies is achieved through the use of precision machined pallets, which assure placement of parts in exact locations for subsequent pick-and-place operations, for examples, at robotic or other stations along an assembly line. In many instances, more than a few hours are required to manufacture such pallets. This is very impractical for small production runs, or for laboratory work where only a few pieces are manufactured. In order to reach production goals and efficiency, a quickly re-configurable pallet is desired.

The idea of flexible manufacturing is known, and there have been many articles written on the subject over the past few years. None, however, is believed to approach flexible manufacturing in a way provided by the present invention.

SUMMARY OF THE INVENTION

In accordance with an aspect of the invention, a method of providing an adaptive manufacturing pallet that conforms to the shape of an object comprises providing a matrix of displaceable object contacts points within a frame, placing the matrix over the object thereby to form a cradle that conforms to the shape of the object, locking the displaceable object contact points in a fixed position relative to each other after the placing step, and using the cradle formed in the locking step as a pallet for holding the object in position during a manufacturing or assembly operation.

In accordance with another aspect of the invention, a flexible manufacturing pallet comprises at least two substantially parallel guide plates having a matrix of guide holes, at least one actuator plate that is substantially parallel to the guide plates and having a matrix of holes substantially aligned with the guides holes of the guide plates, a matrix of pins extending through and displaceable within the matrix of holes of the guide plates and the actuator plate, and an actuator that applies a shear force against and locks the pins in a fixed vertical position relative to said plates whereby to form cradle for holding an object in place. Object contacts points, instead of pins, may also be used in the apparatus aspect of the invention.

These and other aspects and features of the invention will become apparent upon review of the following disclosure taken in connection with the accompanying drawings. The invention, though, is pointed out with particularity by the appended claims.

DESCRIPTION OF ILLUSTRATIVE EMBODIMENT

Figure 1A:
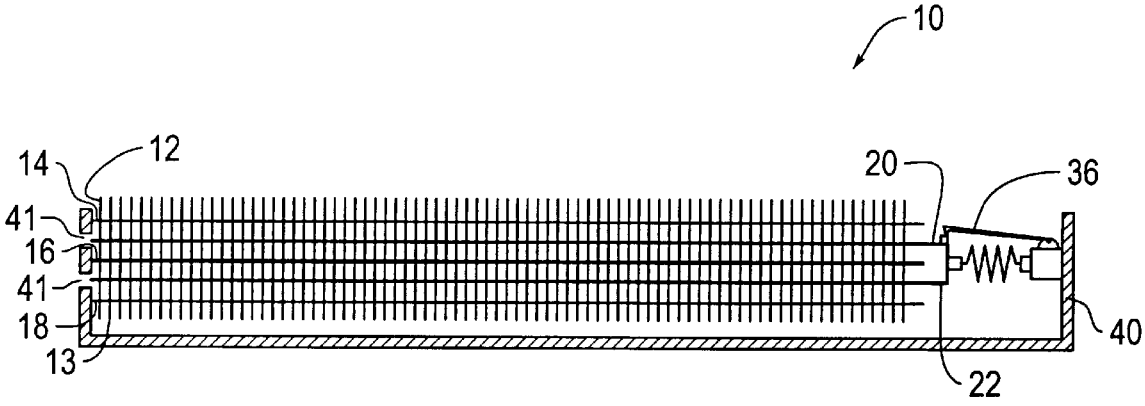
FIG. 1A is a cross-section view, of a parts or object-carrying pallet according the one aspect of the present invention, along line A—A of FIG. 1B.
Figure 1B:
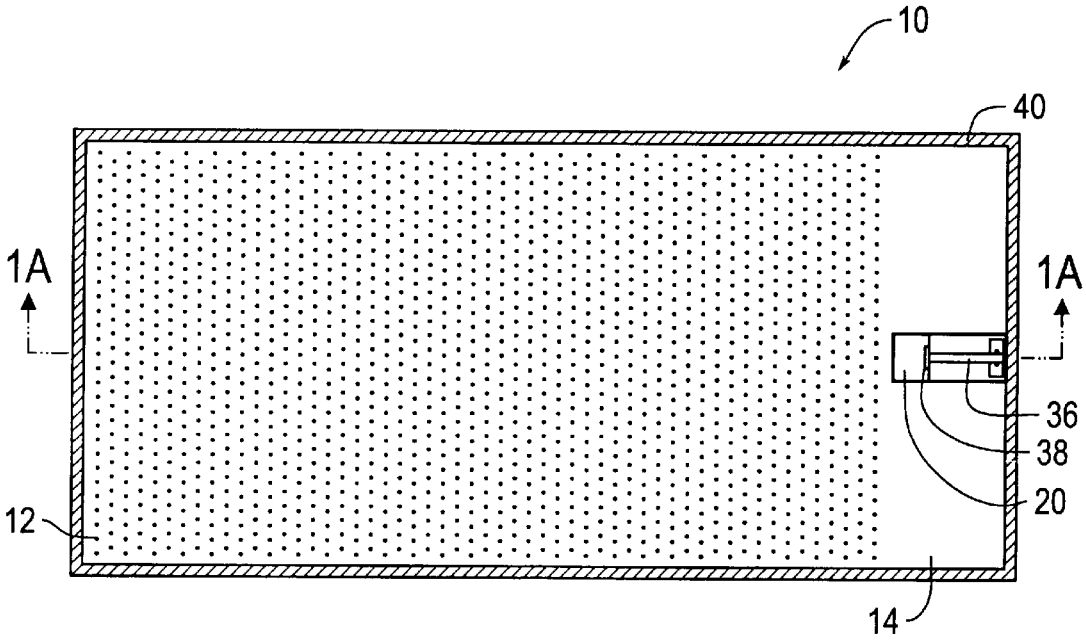
FIG. 1B is a top view of the pallet of FIG. 1A.

FIGS. 1A and 1B show section and top views of principal elements of a flexible manufacturing pallet 10 in accordance with one embodiment of the invention, which is useful for carrying parts and/or to assist in assembly/machining/handling operations during manufacturing or material handling. A pallet frame may take on a variety of forms according to the desired use and manufacturing application. Flexible pallet 10 comprises an array or matrix of displaceable object contact points, such as vertically displaceable and lockable pins, one of which being depicted as a fine rod or pin 12.

In the illustrated embodiment, the matrix is rectangular but may take on any two-dimensional size or geometric shape including square, circular, or polygonal. The length of each pin and displacement permitted displacement thereof (which determines the thickness of a frame holding the assembly together), as well as pin diameter and spacing, may also vary according to the needs of the application. In one embodiment, pin length may range from a couple to several inches and the vertical displacement, e.g., that portion extending above plate 14 in FIG. 1A, may range from a fraction of an inch to several inches. Pin diameter should be sufficient according to the material used for the pins to maintain resistance against lateral shear forces subjected to the work piece when held in place. It is envisioned that the pins may comprise many fine rods of 0.5 mm or less in diameter. Pin spacing in the matrix should meet the desired work piece displacement tolerance when the work piece is held in a cradle or nest formed by the locked pins.

Substantially parallel and stationary plates 14, 16, and 18 are fixedly attached to each other and/or to a frame. A series of associated guide holes journalled through stationary plates 14, 16 and 18 in vertical alignment guide the vertical displacement of pins 12 along their respective axes. The stationary plates 14, 16, and 18 have guide holes, of which normally are in substantially exact axial alignment with and complementary to a corresponding guide hole in a series of spring-loaded actuator plates 20 and 22. In the normal position, the pins 12 are relaxed and freely slidable through the guide holes. Although three stationary plates are shown, only two are required. Also, the function of one stationary plate may be performed by the frame. Vertical displacement of the pins is confined within a specific range so that they do not dislodge completely from the matrix or frame. This, for example, can be achieved by circular collars attached to the pins between the plates.

The series of spring-loaded actuator plates 20 and 22 substantially parallel to plates 14, 16, and 18 also include guide holes for pins 12. Actuator plates 20 and 22 are held substantially parallel to stationary plates 14, 16, and 18 by an actuator fixedly attached to stationary plates and/or to a frame actuator plates 20 and 22 are supported by the frame 40 by at least one slot 41 within the frame 40; and are capable of extending through and being displaceable within the slot 41. The stationary plates 14, 16 and 18 held in substantially exact axial alignment with the actuator plates 20 and 22 by a latch 36 and 38 when the actuator (subsequently described) is not released. Actuator plates 20 and 22 react to a manual or a powered actuator to apply a lateral shear force F to pins 12, causing them to engage the guide plates 14, 16, and 18. Shear force F applied by actuator plates effects locking of pins 12 in place thereby to form a "custom fit" cradle to hold a work piece in place. In the illustrated embodiment, actuator plates 20 and 22 react and are tied together although the plates may be separated and individually actuated. Pins 12 may possess some degree of flexibility, having a modulus of elasticity so that they bend or flex somewhat in the lateral direction in response to a shear force thereby to more evenly spread the shear force among the pins and to obtain more even friction locking of all the pins in a fixed vertical position against the stationary plates.

Elasticity in the lateral direction may also be provided or distributed by the material, design, or construction of the actuator plates. For example, an elastic or flexible Teflon, plastic, or soft metal bushing may be inserted in the guide holes of one or more of the actuator plates through which the pins protrude in order to more evenly distribute the lateral shear force F of actuator plates 20 and 22 among the pins in the matrix. A similar function may be performed by the actuator plates themselves if they comprise a material having a high modulus of elasticity. Also, a single actuator plate or multiple (more than two) actuator plates may be used.

The material of plates 14, 16, 18, 20, and 22, as well as that of pins 12, preferably comprises a high carbon plate or sheet metal steel in order to achieve durability. Other materials, however, may be used where durability is not necessary. Aluminum or an alloy thereof may be used for any or all of plates 14, 16, 18, 20, and 22 to attain a lighter weight flexible manufacturing pallet.

A closer mechanical tolerances preferably exists between the diameter of pins 12 and guide holes journalled through plates 14, 16, and 18 than that which may exist between the diameter of pins 12 and holes of actuator plates 20 and 22. This arrangement may be preferred to attain minimal play during vertical displacement of pins 12 in order to achieve a "tight fit" when the work piece or object rests within the custom fit cradle established by the displaced, locked pins 12. When the actuator plates 20 and 22 are relaxed, mechanical design tolerance between the respective diameters of pins 12 and holes in stationary plates should permit the pins to dislodge from their lock position and fall to a downward neutral position under force of gravity.

In the case where pins 12 are spring-loaded or otherwise biased along their displaceable axes, the pallet may be used in a non-horizontal position. Biasing may be provided by spring action, e.g., a coil spring attached to ends 13 of each pin 12, that can be attained by various mechanical or electromechanical arrangements well-known it the art.

Advantageously, the invention eliminates the need for custom-made pallets for machine tooling, parts handling, assembly operations, or laboratory process or development work since the flexible, adaptive pallet illustrated herein may be quickly reconfigured to adapt to various shapes and sizes of work pieces or parts. To set the pallet for a given configuration, the part or work piece may be placed upside down on a flat surface. The pallet is then laid over the part or work piece while the pins are relaxed, e.g., unlocked. Thereafter, a locking mechanism is engaged (or a spring-loaded mechanism is released depending on whether positive or negative locking is used) to lock the pins in place. This results in an adaptive, custom-fit cradle for the part or work piece.

Figure 2A:
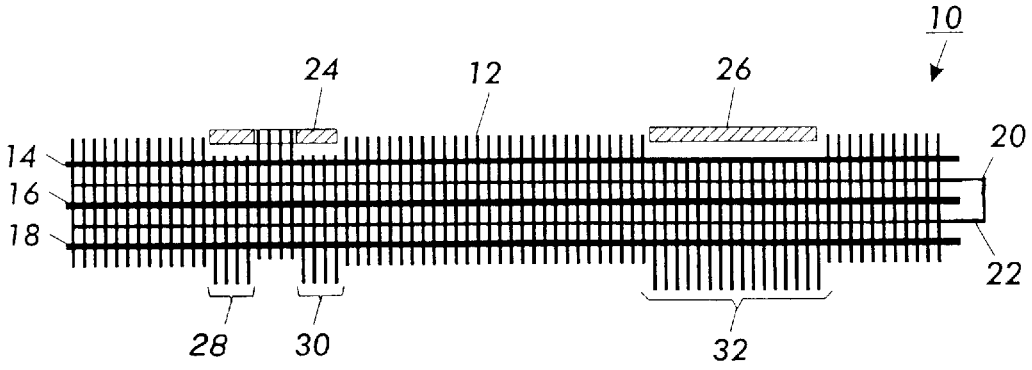
FIG. 2A shows the pallet of FIG. 1A embodying objects nested in respective cradles formed by the adaptive pallet.
Figure 2B:
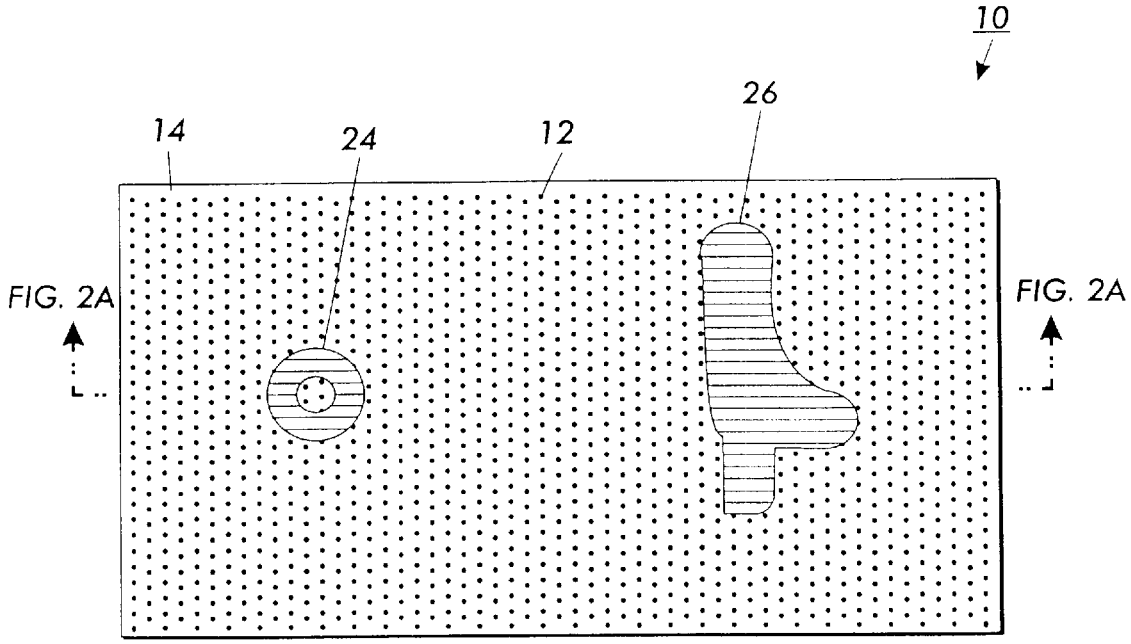
FIG. 2B is a top view of the pallet and objects of FIG. 2A.

FIGS. 2A and 2B respectively show side and top views of an adaptive flexible pallet according to an aspect of the invention. FIG. 2A is a cross-section along lines A—A of FIG. 2B. As illustrated in the cross-section of FIG. 2A, the flexible pallet embraces two work pieces 24 and 26 positioned in respective cradles formed by displaced pin groups 28, 30, and 32. A "custom-fit" exact fit cradle formed by displaced, locked pin groups 28 and 30 in relation to other surrounding pins holds work piece 24 in place. Likewise, a cradle formed by pin group 32 in relation to the surrounding pins holds work piece 26 in place.

Figure 3:
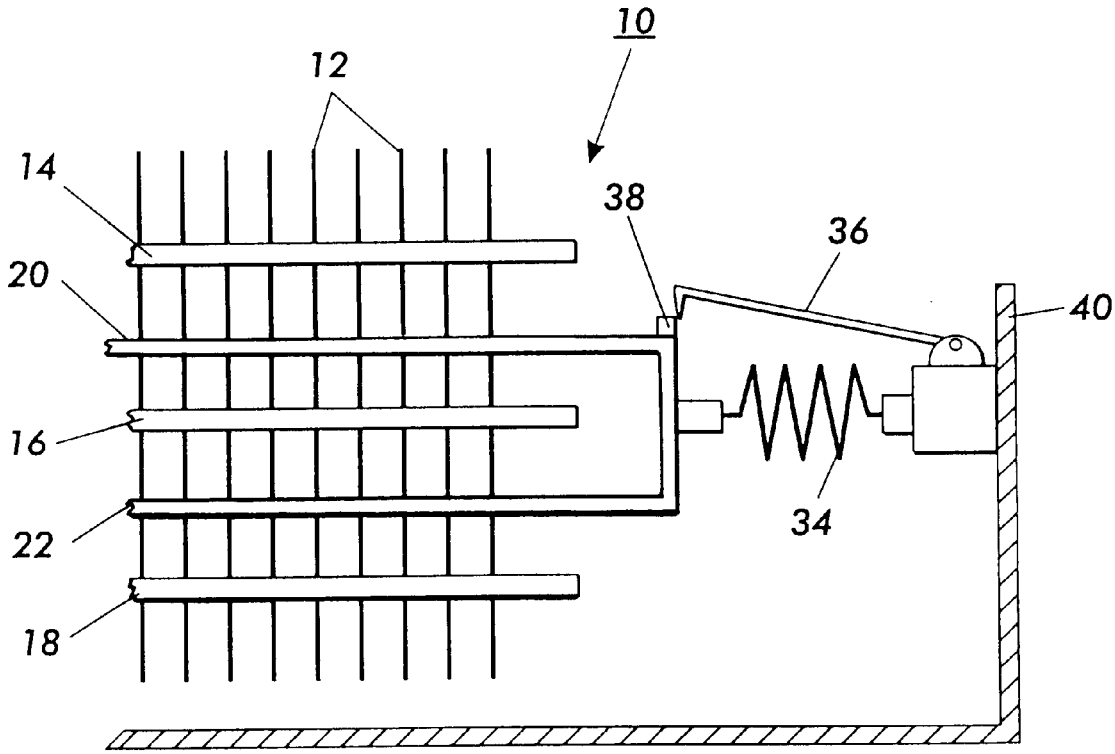
FIG. 3 depicts an illustrative locking/release mechanism that may be used to lock the pins or object contact points in place.

FIG. 3 illustrates one type of mechanism that releases spring action, i.e., shear force F, against the actuator plates 20 and 22 to effect locking of rods or pins 12. To release the spring action, plate assembly 20 and 22 is pulled (manually or otherwise) towards spring 34 and locking arm 36 engages (manually or otherwise) stop 38 attached to plate assembly 20 and 22 in order to remove lateral shear force F from the plates 20 and 22. When force F is removed, pins 12 freely slide vertically within guide holes of plates 14, 16, 18, 20 and 22. At this point, frame 40 together with the pins and plates are inverted and laid over parts or work pieces. Once in place, the pins contacting the parts or work pieces displace vertically and locking arm 36 is disengaged from stop 38 thereby causing spring 34 to apply shear force F against plates 20 and 22 to lock the pins in place. The pallet is then "configured" for a part or work piece for use in various operations, illustrated herein.

The invention may include apparatuses and methods that vary from the illustrated embodiments. For example, the illustrated embodiment depicts mechanical locking of pins, rods, or object contact points, but other locking methods, e.g., magnetic or electromagnetic, may be employed. Pins or rods are shown to adapt to the work piece, but the invention is not limited to such structures. Holes and pins need not be circular, but may have an elongated cross-sectional or other shape where slots instead of circular holes may exist in the plates or other guide/locking structure. Other mechanical or electromechanical displaceable structures may be used to form a cradle or nest for holding work pieces or parts. Structures other than the illustrated plates may be used to guide and/or lock the pins, rods, or such other structures to form a nest or cradle about the parts or work pieces. Also, the illustrated pin locking mechanism should not be viewed as a limitation of the invention. Accordingly,

What is claimed is:

1. An adaptive parts carrying and manufacturing pallet comprising:

a frame, a series of substantially parallel guide plates attached to the frame, the guide plates having a matrix of guide holes or slots, a series of actuator plates that are substantially parallel to said guide plates and supported by slots within the frame, each actuator plate of the series of actuator plates capable of extending through and being displaceable within the respective slot of the slots, and the series of actuator plates having a matrix of holes or slots substantially aligned with and complementary to the guide holes or slots of the guide plates, a matrix of pins extending through and displaceable within the matrix of holes or slots of the guide plates and the series of actuator plates, an actuator that applies a shear force to the series of actuator plates, said series of actuator plates transferring said shear force to the pins to lock the pins in a fixed vertical position relative to said guide plates whereby to form a cradle for holding a part or work piece in place, said actuator being released to apply a spring-loaded shear force against said series of actuator plates to lock the pins, and a latch to latch said series of actuator plates in alignment with said series of guide plates.

2. A flexible manufacturing pallet comprising:

at least two substantially parallel guide plates having a matrix of guide holes, a plurality of actuator plates that are substantially parallel to said guide plates and having a matrix of holes substantially aligned with and complementary to the guide holes of the guide plates, a matrix of unbiased pins extending through and displaceable within the matrix of holes of the guide and actuator plates, an actuator that applies a shear force to the plurality of actuator plates, said plurality of actuator plates transferring said shear force to the unbiased pins to lock the unbiased pins in a fixed vertical position relative to said guide plates whereby to form cradle for holding an object in place, wherein said actuator is released to apply a spring-loaded shear force against said plurality of actuator plates to lock the unbiased pins, and a latch to latch said plurality of actuator plates in alignment with said guide plates.

3. The flexible manufacturing pallet as claimed in claim 2, wherein said actuator is released to apply a spring-loaded shear force against said at least one actuator plate to lock the pins.

4. A method of re-configuring a flexible manufacturing pallet to conform to a shape of a work piece or part comprising:

providing a matrix of unbiased pins that are displaceable within a frame, providing a plurality of actuator plates supported by said frame with a plurality of slots within the frame, extending the a plurality of actuator plates through the plurality of slots, placing the matrix of pins over the work piece or object thereby to form a cradle that conforms to the shape of the object, providing a force to the plurality of actuator plates, locking the unbiased pins in a fixed position relative to each other after the placing step, and using the cradle formed in the locking step as a pallet in a parts carrying operation during manufacturing.

5. A method providing an adaptive manufacturing pallet that conforms to the shape of an object, said method comprising:

providing within a frame a matrix of displaceably unbiased object contact points, providing a plurality of actuator plates, supported by said frame by a plurality of slots within the frame, extending the plurality of actuator plates through the plurality of slots, placing the matrix over the object thereby to form a cradle that conforms to the shape of the object, providing a force to the plurality of actuator plates, locking the displaceably unbiased object contact points in a fixed position relative to each other after the placing step, and using the cradle formed in the locking step as a pallet for holding the object in position during an object handling operation.

* * * * *